United States Patent [19]

Hanyu

[11] Patent Number: 4,620,496

[45] Date of Patent: Nov. 4, 1986

[54] PATTERN SELECTING DEVICE OF AN ELECTRONIC CONTROL SEWING MACHINE

[75] Inventor: Susumu Hanyu, Tokyo, Japan

[73] Assignee: Janome Sewing Machine Co., Ltd., Tokyo, Japan

[21] Appl. No.: 699,864

[22] Filed: Feb. 8, 1985

[30] Foreign Application Priority Data

Feb. 17, 1984 [JP] Japan ..... 59-27337

[51] Int. Cl.[4] ..... D05B 3/02

[52] U.S. Cl. ..... 112/445; 112/458

[58] Field of Search ..... 112/158 F, 158 E, 444, 112/445, 458, 453

[56] References Cited

U.S. PATENT DOCUMENTS 4,135,461 1/1979 Sedlatschek ..... 112/158 F X 4,365,566 12/1982 Laidig ..... 112/158 F

*Primary Examiner*—Peter Nerbun

*Attorney, Agent, or Firm*—Michael J. Striker

[57] ABSTRACT

This invention provides a pattern selecting device of an electronic control sewing machine which stores stitching pattern data in a memory device. A plurality of indicating windows are arranged in columns and rows at a front part of the sewing machine. The indications of the patterns are made selectively visible according to a stitching pattern group of each of plural modes, in response to the operation of a mode switching member, and stitching patterns in response to the pattern indications in the column or the row are successively selected, and the selected patterns are specifically indicated by illumination.

2 Claims, 9 Drawing Figures

PATTERN SELECTING DEVICE OF AN ELECTRONIC CONTROL SEWING MACHINE

FIELD OF THE INVENTION

This invention relates to a pattern selecting device of an electronic control sewing machine which is provided with an electronic memory device storing stitching pattern data for various stitching patterns, and which forms stitching patterns in accordance with the stitching pattern data.

BACKGROUND OF THE INVENTION

An electronic memorization element incorporated in a sewing machine is constructed on a considerably small scale, in spite of a large memorization capacity, in accordance with recent improvement of semi-conductor integration technology. Therefore, the electronic control sewing machine has been able to store more pattern data for the stitching patterns in comparison with conventional mechanical sewing machines. For selecting the patterns in the electronic control sewing machine, there are required indications of the patterns to be selected, and pattern selecting keys to be operated individually for the respective patterns. When these indications and keys increase in number, the outer appearance of the sewing manchine is unpaired, and errors can easily be made in the selection of the patterns.

For dealing with such problems, an Australian patent application No. 10,996/83 and U.S. patent application Ser. No. 462,935 now U.S. Pat. No. 4,580,513 assigned to the assignee, have been filed with respect to "Pattern Selecting Device for Electronic Sewing machines".

This prior device requires two panels, a first panel for indicating pattern shapes of a first pattern group and a second panel for indicating pattern shapes of second and third pattern groups. Each of the patterns of the second and third pattern groups is indirectly selected by inputting a number of two figures. The pattern selection of the first pattern group is carried out by direct and indirect ways in accordance with the switching conditions of a switch having three operating positions. Consequently, the operation is cumbersome.

SUMMARY OF THE INVENTION

This invention is to provide a pattern selecting device of an electronic control sewing machine which stores stitching pattern data in an incorporated memory device, wherein a plurality of separate indicating windows are arranged in columns or rows at a front part of the sewing machine, and indications of the patterns are made selectively visible in response to stitching pattern group of each of plural modes, in relation with operation of a mode switching member, and stitching patterns in response to the pattern indications in the column or the row are successively selected, and said patterns are specifically indicated by illumination.

Thus, it is an object of the invention to accumulate indicating parts of a pattern selecting device for various stitching patterns at one position in a front panel of the sewing machine.

It is another object of the invention to carry out selection of the stitching patterns by a direct operation of a pattern selecting key, thereby to settle troublesome problems in the pattern selection as seen in the prior art.

DETAILED DESCRIPTION OF THE INVENTION

An explanation will be made in reference to the most preferred embodiment of the invention.

Figure 1:
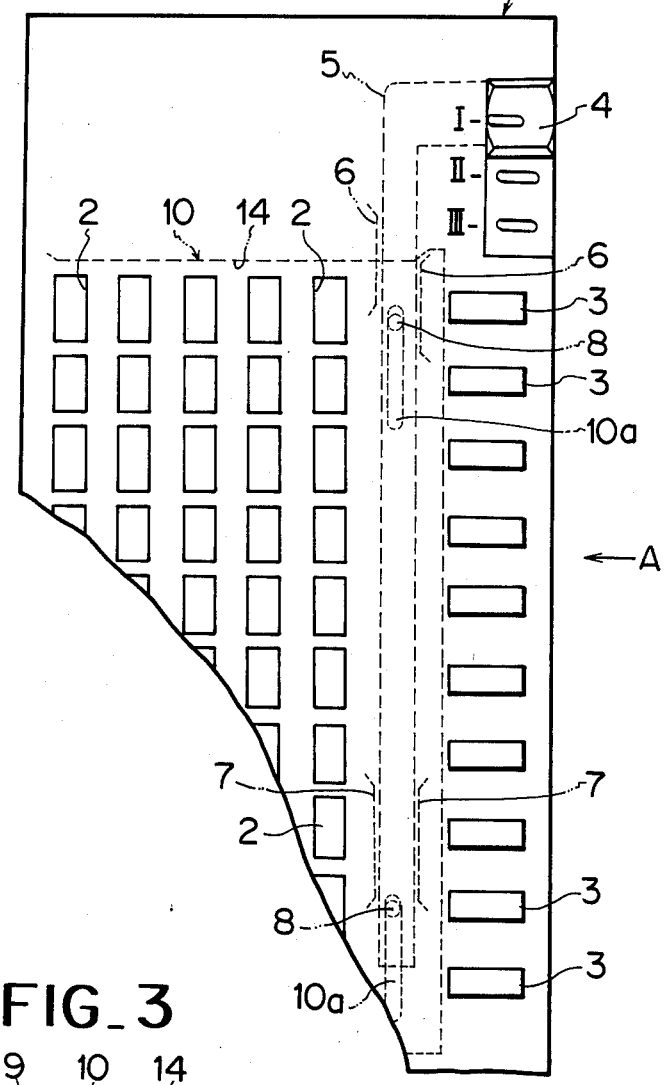
FIG. 1 is a view showing a pattern indicating board taken out from an operating part of an indicating part of a pattern selecting device.
Figure 2:
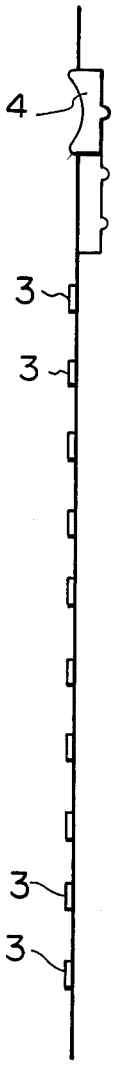
FIG. 2 is a view seen in the direction of arrow A in FIG. 1.
Figure 3:
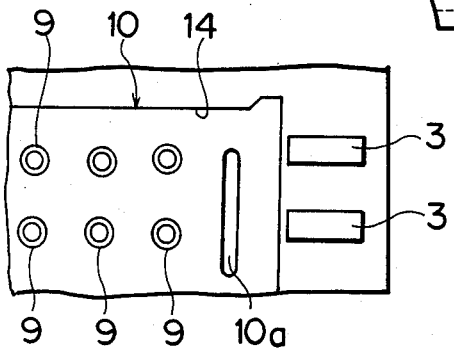
FIG. 3 is a view showing LED atttached to a machine frame and an attaching plate thereof.

In FIG. 1, a front panel 1 of a sewing machine is made of a transparent material and is masked so as to provide an array of indicating windows 2. The windows 2 are arranged in columns and rows, and each of the windows is independent. Pattern selection keys 3 are positioned in correspondence to any one of the columns or rows (in the present embodiment, to the keys 3 are aligned with the columns).

A mode changing key 4 is movable between three positions with respect to a machine frame, and switches over a mode converting switch (not shown) into corresponding positions.

The mode key 4 is connected to a slide key board 5. The slide key board 5 is guided by guide parts 6 and 7, and has pins 8 implanted at upper and lower parts thereof. Rollers may be used instead of the pins 8.

An attaching plate 10 supports an array of light emitting diodes LED 9 and is positioned in a spaced relation to the slide key board 5. The plate 10 is formed with grooves 10*a* at the upper and lower parts, and the pins 8 of the slide key board 5 are guided therein.

The plate 10 with the plurality of LED 9 is located rearward of the front panel 1 and the light emitting diodes are positioned in pattern indicating windows 2. For indication of specific patterns, the light emitting diodes LED 9 are activated to show, respectively one specific pattern indication, as it will be explained below.

Figure 4:
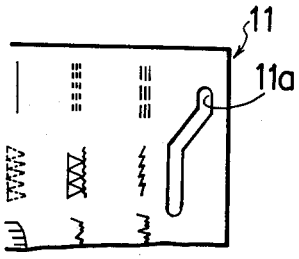
FIGS. 4, 5 and 6 are views showing cutaway parts of the pattern indication boards pertaining respectively to stitching patterns of 1st, 2nd and 3rd modes.
Figure 5:
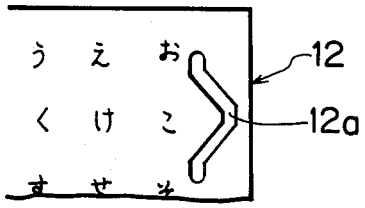
Figure 6:
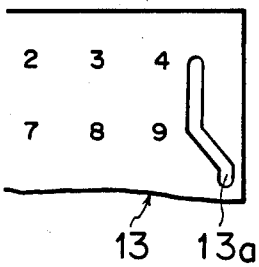

In FIGS. 4, 5 and 6, pattern indication boards 11, 12 and 13 are made of transparent material, and are printed, in this order, with stitching patterns of 1st, 2nd and 3rd stitching modes.

The stitching pattern groups in the 1st mode of the present embodiment includes practical stitching, ornamental stitching and buttonhole stitching patterns.

The stitching pattern group of the 2nd mode includes Japanese letters, and the stitching pattern group of the 3rd mode includes numeric and alphabetic characters.

Pattern indication boards 11,12 and 13 are superposed between the front panel 1 and the plate 10 (carrying the LEDs 9). One of the boards is selected by operating the mode changing by 4, and the patterns imprinted on the designated board is shown through respective windows 2 of the front panel 1. If the pattern selection board 11 is selected (FIG. 7), each of the patterns imprinted on the board comes between each windows 2 of the front panel 1 and the corresponding LED 9 of the plate 10. However, for the display of the three kinds of buttonhole patterns (B1)(B2)(B3), there are provided three light emitting diodes, namely an upper LED(9*a*), a center LED(9*b*) and a lower LED(9*c*).

When a buttonhole is stitched, light emitting diodes 9*a* to 9*c* are successively lighted by a computer program in response to progress of stitching of the buttonhole. For example, the center LED(9*b*) is lighted when a right side line tack is stitched, the lower LED(9*c*) is lighted when a lower bar-tack or the corresponding part is stitched, the center LED(9*b*) is again lighted when a left-side line-tack is stitched and the upper LED(9*a*) is lighted when an upper bar-tack or the corresponding part is stitched.

After selecting the buttonhole stitching pattern, the center LED 9*b*, for example, is lighted.

Figure 8:
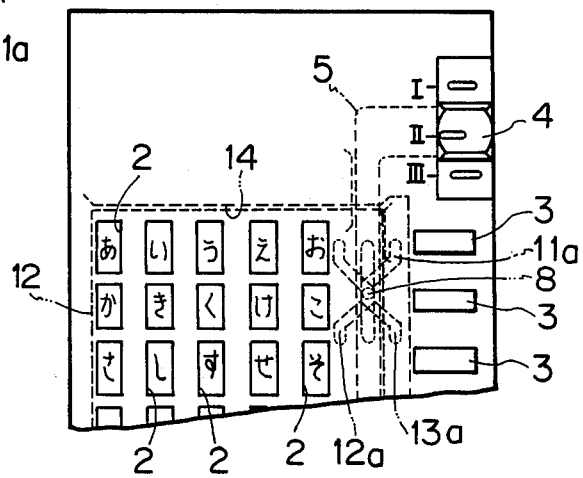
FIGS. 7, 8 and 9 are views showing switching conditions corresponding to 1st mode, 2nd mode and 3rd mode.
Figure 9:
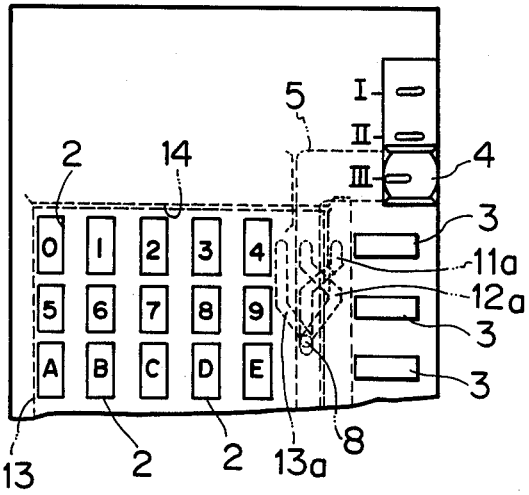
Figure 7:
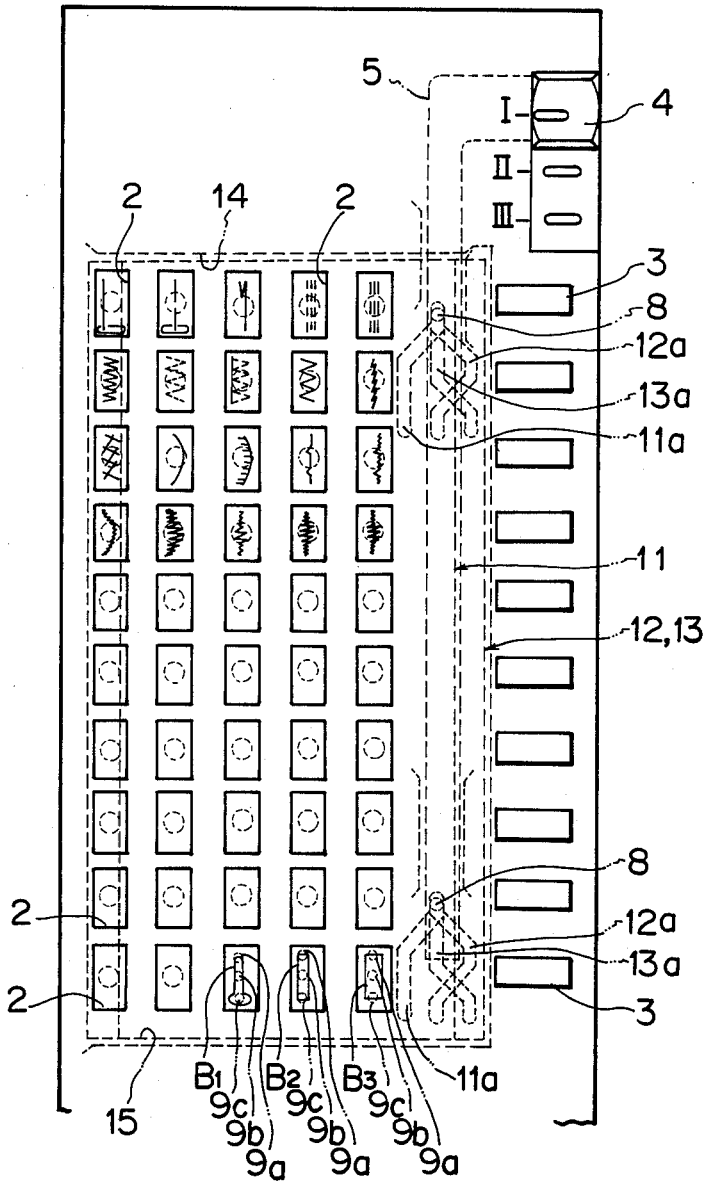

As shown in FIGS. 4–6, the pattern indication boards 11, 12 and 13 are provided with cam grooves 11*a*, 12*a*, and 13*a* formed at the upper and lowe corners thereof for receiving the upper and lower pins 8 of the slide key board 5 (FIGS. 7–9). The cam grooves 11*a*, 12*a*, 13*a* are designed such as to selectively shift the respective pattern indication boards 11, 12, 13 laterally of the front panel 1 and the LED 9 carrying plate 10 when the mode changing key 4 is operated.

An explanation will be made as to the working of the embodiment of the invention.

When the mode changing key 4 is switched to the 1st position I mode as shown in FIG. 7, the converting switch is switched to the 1st mode, while pins 8 engage upper portions of cam grooves 11*a*, 12*a* and 13*a* in the boards 11, 12 and 13, as shown by dashed lines. Under this condition, the pattern indication board 11 pertaining to the stitching pattern group of the 1st mode, appear in the indication window 2, and the indications on the pattern indication boards 12 and 13 are covered by the mask at the right side of the indication window 2 as seen in FIG. 7, and only the transparent parts without the patterns come into the indication windows.

When one of the pattern selection keys 3 is operated under the above condition, an initial LED is lighted in the corresponding column of windows 2 to identify the desired pattern through the corresponding initial window, and simultaneously the desired pattern stored in the computer is selected through a pattern selection circuit. If the same pattern selection key 3 is operated once again, the initial LED is switched off and then the second LED is lighted in the second window of the same column to illiminate another pattern. Thus each time the same pattern selection key 3 is operated, the LED is switched on and off from the right end to the left end of the column to illuminate different patterns one after another.

When the mode converting key 4 is switched to the 2nd mode as shown in FIG. 8, the mode changing switch is switched converting to the 2nd mode, while the pin 8 engages the center portion of the cam grooves 11*a*, 12*a* and 13*a*. Under this condition, the pattern indication board 12 is shifted in the left direction and the board 11 is shifted in the right direction while the board 13 remains in the rightward position. Thus each of the second mode patterns comes to each of the pattern indication windows 2 while the first mode patterns are positioned behind the masked part of the front panel 1 and are not indicated. Finally, when the mode changing key 4 is switched to the 3rd position III, the pattern indication board 13 is shifted in the left direction and the board 12 is shifted in the right direction. Then the third mode patterns are indicated through the respective pattern indication windows 2 of the front panel 1. In the second and third modes, any patterns may be optionally selected in each column by repeatedly operating the corresponding pattern selection key 3 just in the same manner as in the case of the first mode. Thus according to the invention, a number of pattern indication boards are accumulated in one place of the sewing machine and those pattern indication boards, each of which has many patterns imprinted thereon, may be selectively designated by operation of a single mode changing key, and all the patterns of the first, second and third modes may be optionally selected by operation of a reduced number of pattern selection keys. More over so many patterns to be selected, the reduced number of pattern selection keys and the single mode changing key to be operated are so compactly arranged in one limited place of the sewing machine and so closely arranged to each other. Therefore, so many patterns may be very easily selected without committing errors and having a sense of difficulty which may otherwise generally happen with the users in dealing with the sewing machine.

I claim:

1. A stitching pattern selecting device for use in an electrically controlled sewing machine, comprising a memory device for storing stitching pattern data, a front panel arranged at a front part of a sewing machine, said front panel being formed with a plurality of windows arranged in rows and columns, an attachment plate supporting an array of light emitting elements positioned behind the windows of the front panel, a plurality of transparent pattern indication boards superposed between the front panel and the attachment plate and being shiftable relative to each other, each pattern indication board having various stitching patterns imprinted thereon and being provided with at least one cam groove, switching means including a stitching mode changing key which is operable between a plurality of set positions, a slide key board connected to said stitching mode changing key and being movable between a plurality of set positions corresponding to the set positions of said stitching mode changing key, said slide key board having at least one projection formed thereon, said projection and said cam grooves of said pattern indicating boards cooperating with each other, as said stitching mode changing key is operated to one of said set positions thereof to thereby shift a selected pattern indication board in a display position in which the stitching patterns imprinted thereon are situated between the windows and the light emitting elements while only the transparent positions of the remaining pattern indication boards are situated in the windows, means for selecting a specific stitching pattern data stored in the memory device, said selecting means being coupled to said switching means so as to activate a light emitting element pertaining to an imprinted stitching pattern which corresponds to the selected stitching pattern data.

2. A stitching pattern selecting device as defined in claim 1 wherein said selecting means includes a plurality of pattern selection keys arranged on said front panel and electrically connected to said memory device.

* * * * *